US010851520B2

(12) United States Patent
Fukuda et al.

(10) Patent No.: US 10,851,520 B2
(45) Date of Patent: Dec. 1, 2020

(54) HYDRAULIC SYSTEM FOR WORKING MACHINE

(71) Applicant: KUBOTA CORPORATION, Osaka (JP)

(72) Inventors: Yuji Fukuda, Osaka (JP); Keigo Honda, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 16/366,175

(22) Filed: Mar. 27, 2019

(65) Prior Publication Data

US 2019/0301137 A1 Oct. 3, 2019

(30) Foreign Application Priority Data

Mar. 28, 2018 (JP) ..... 2018-062420
Nov. 14, 2018 (JP) ..... 2018-214077

(51) Int. Cl.
*E02F 9/20* (2006.01)
*E02F 9/22* (2006.01)

(52) U.S. Cl.
CPC ..... *E02F 9/2004* (2013.01); *E02F 9/2225* (2013.01); *E02F 9/2267* (2013.01); *F15B 2211/20546* (2013.01); *F15B 2211/255* (2013.01); *F15B 2211/41572* (2013.01)

(58) Field of Classification Search
CPC .. F15B 2211/30625; F15B 2211/30525; F15B 2211/3105; F15B 2211/3122; F15B 2211/3133; F15B 2211/31511; E02F 9/2285; E02F 9/2267; E02F 9/2004
See application file for complete search history.

(56) References Cited

U.S. PATENT DOCUMENTS

2017/0175779 A1* 6/2017 Fukuda ..... F15B 11/16

FOREIGN PATENT DOCUMENTS

JP 2010270527 12/2010

* cited by examiner

*Primary Examiner* — Abiy Teka
(74) *Attorney, Agent, or Firm* — Greenblum & Bernstein, P.L.C.

(57) ABSTRACT

A hydraulic system for a working machine includes a hydraulic pump, a first hydraulic actuator, a second hydraulic actuator, a first control valve to control the first hydraulic actuator, a second control valve to control the second hydraulic actuator, and a discharge fluid tube in which the operation fluid flows. The discharge fluid tube is connected to the first control valve. The hydraulic system includes a first fluid tube in which a return fluid flows toward the second control valve. The first fluid tube couples the first control valve to the second control valve. The hydraulic system includes a second fluid tube coupling the first fluid tube and the discharge fluid tube, a first throttle disposed on the first fluid tube, and a second throttle disposed on the second fluid tube, the second throttle having an opening area smaller than an opening area of the first throttle.

22 Claims, 10 Drawing Sheets

16
18
83a
83b
20c1
20c3
20(20C)
20c2
44a
44b
44c
72
17
17
17c
17d
17a
17b
17e
22b
22a
22
20b1
43c
73c
36
20(20B)
181
20b2
251
35
20b3
38
250
81c
210
34a
43a
42a
34b
43b
42b
42c
81a
81b
24b4
14
14b
14a
14e
14
14c
14d
29a
51
24b5
63
21b
21a
21
20a1
20(20A)
20a3
53c
31
32
41c
20a2
61
24b1
37
61a
33a
41a
46a
33b
41b
46b
46c
61b
27a
25
24a
24b3
24b2
24b
P1
27
E
P2
7
15

16
18
83a
83b
20c1
20c3
20(20C)
20c2
44a
44b
44c
72
17
17
17c
17d
17a
17b
17e
22b
22a
22
20b1
43c
73c
36
20(20B)
20b2
35
20b3
81
38
34a
34b
81a
81b
43a
43b
42a
42b
42c
24b4
14
14b
14a
14e
14
14c
14d
29a
51
85
200
63
24b5
21b
21a
21
20a1
20(20A)
20a3
53c
31
32
41c
61a
20a2
351
61
24b1
37
350
110
201
33a
33b
41a
41b
46a
46b
46c
61b
27a
25
24a
24b2
24b3
24b
P1
27
E
P2
7
15

16
18
83a
83b
20c1
20c3
20(20C)
20c2
44a
44b
44c
72
300
17
17
17c
17d
17a
17b
17e
22b
22a
22
20b1
43c
73c
36
20(20B)
181
451
35
20b2
20b3
38
301
450
81c
210
34a
43a
42a
34b
81a
43b
42b
42c
81b
24b4
14
14b
14a
14e
14
14c
14d
21b
21a
21
29a
51
24b5
63
61
20a1
20a3
31
41c
20a2
20(20A)
53c
32
61a
24b1
37
33a
41a
46a
33b
41b
46b
46c
61b
27a
25
24a
24b3
24b2
24b
P1
27
E
P2
7
15

16
18
83a
83b
20c1
20c3
20(20C)
20c2
44a
44b
44c
72
17
17
17c
17d
17a
17b
17e
22b
22a
22
20b1
43c
73c
36
20(20B)
20b2
35
20b3
81
38
34a
34b
81a
43a
43b
42a
42b
42c
81b
24b4
14
14b
14a
14e
14
14c
14d
29a
51
24b5
63
21b
21a
21
20a1
20a3
31
41c
20a2
20(20A)
53c
32
150
151
61
24b1
37
110
61a
33b
33a
41b
41a
46b
46a
46c
61b
24a
24b3
27a
25
24b2
24b
500
P1
27
E
P2
7
15

HYDRAULIC SYSTEM FOR WORKING MACHINE

CROSS-REFERENCE TO RELATED APPLICATIONS

The present application claims priority under 35 U.S.C. § 119 to Japanese Patent Application No. P2018-062420, filed Mar. 28, 2018 and to Japanese Patent Application No. P2018-214077, filed Nov. 14, 2018. The contents of these applications are incorporated herein by reference in their entirety.

BACKGROUND OF THE INVENTION

Field of the Invention

The present invention relates to a hydraulic system for a working machine and to a control valve.

Description of Related Art

A hydraulic system for a working machine disclosed in Japanese Patent Application Publication No. 2010-270527 is conventionally known. The working machine disclosed in Japanese Patent Application Publication No. 2010-270527 includes a boom, a bucket, a boom cylinder to move the boom, a bucket cylinder to move the bucket, an auxiliary actuator to actuate an auxiliary attachment, a first control valve to control stretching and shortening of the boom cylinder, a second control valve to control stretching and shortening of the bucket cylinder, and a third control valve to actuate the auxiliary actuator.

SUMMARY OF THE INVENTION

A hydraulic system for a working machine includes a hydraulic pump to output an operation fluid, a first hydraulic actuator, a second hydraulic actuator, a first control valve to control the first hydraulic actuator, a second control valve to control the second hydraulic actuator, the second control valve being arranged on a downstream side of the first control valve, and a discharge fluid tube in which the operation fluid having passed through the first control valve flows. The discharge fluid tube is connected to the first control valve. The hydraulic system further includes a first fluid tube in which a return fluid that is the operation fluid returning from the first hydraulic actuator to the first control valve flows toward the second control valve. The first fluid tube couples the first control valve to the second control valve. The hydraulic system further includes a second fluid tube coupling the first fluid tube and the discharge fluid tube, a first throttle disposed on the first fluid tube, and a second throttle disposed on the second fluid tube, the second throttle having an opening area smaller than an opening area of the first throttle.

A hydraulic system for a working machine, includes a hydraulic pump to output an operation fluid, a first hydraulic actuator, a second hydraulic actuator, a first control valve to control the first hydraulic actuator, a second control valve to control the second hydraulic actuator, the second control valve being arranged on a downstream side of the first control valve, and a discharge fluid tube in which the operation fluid having passed through the first control valve flows. The discharge fluid tube being connected to the first control valve. The hydraulic system further includes a first fluid tube in which a return fluid that is the operation fluid returning from the first hydraulic actuator to the first control valve flows toward the second control valve. The first fluid tube couples the first control valve to the second control valve. The hydraulic system further includes a second fluid tube coupling the first fluid tube and the discharge fluid tube, a third fluid tube in which the operation fluid having passed through the first control valve flows toward the second control valve separately from the first fluid tube, a third throttle disposed on the second fluid tube, and a fourth throttle disposed on the third fluid tube, the fourth throttle having an opening area smaller than an opening area of the third throttle.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
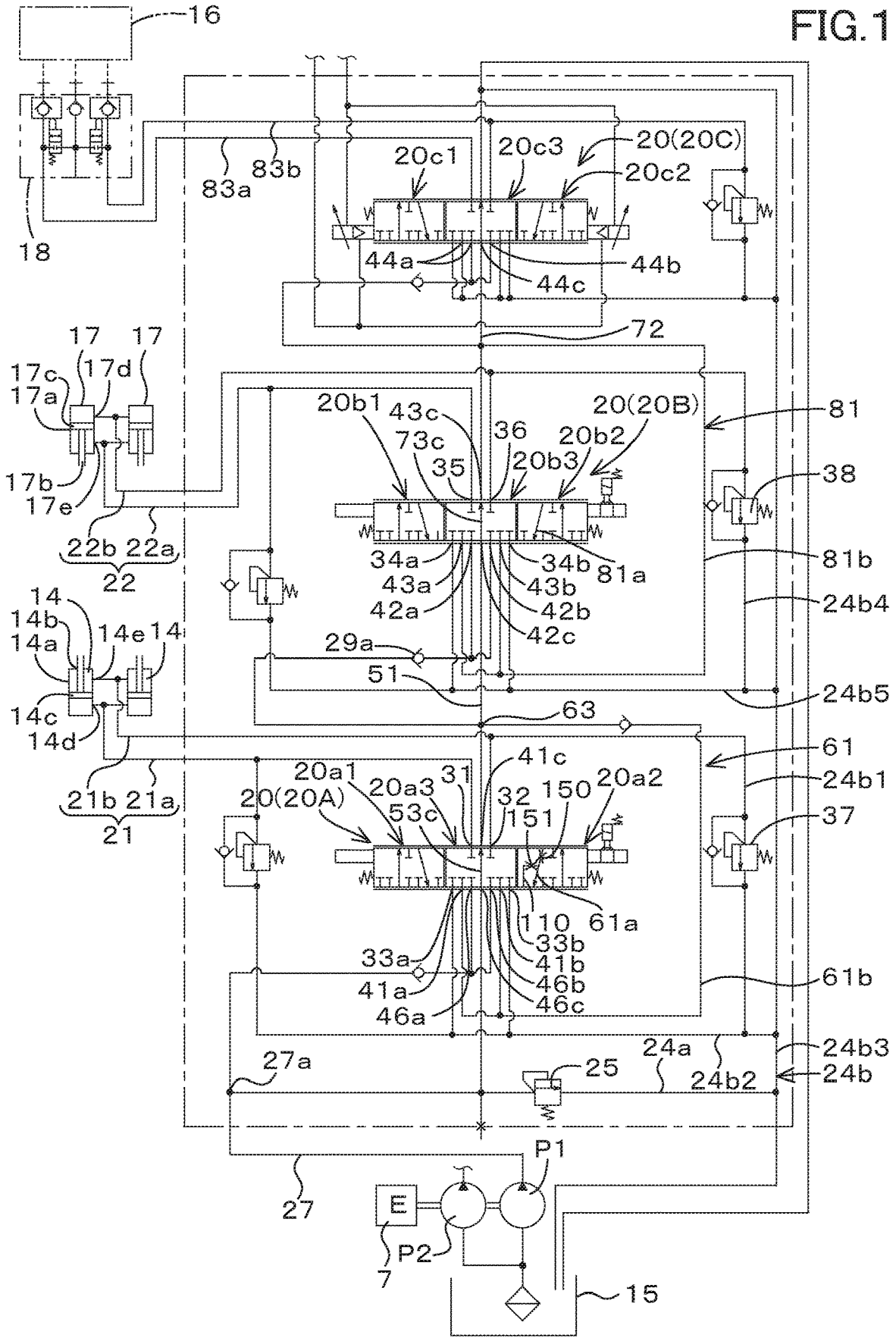
FIG. 1 is a view illustrating a hydraulic system (hydraulic circuit) for a working machine according to an embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described below with reference to the drawings as appropriate.

Specifically, embodiments of a hydraulic system for a working machine according to the present invention and of the working machine having the hydraulic system will be described below with reference to the drawings as appropriate.

Figure 8:
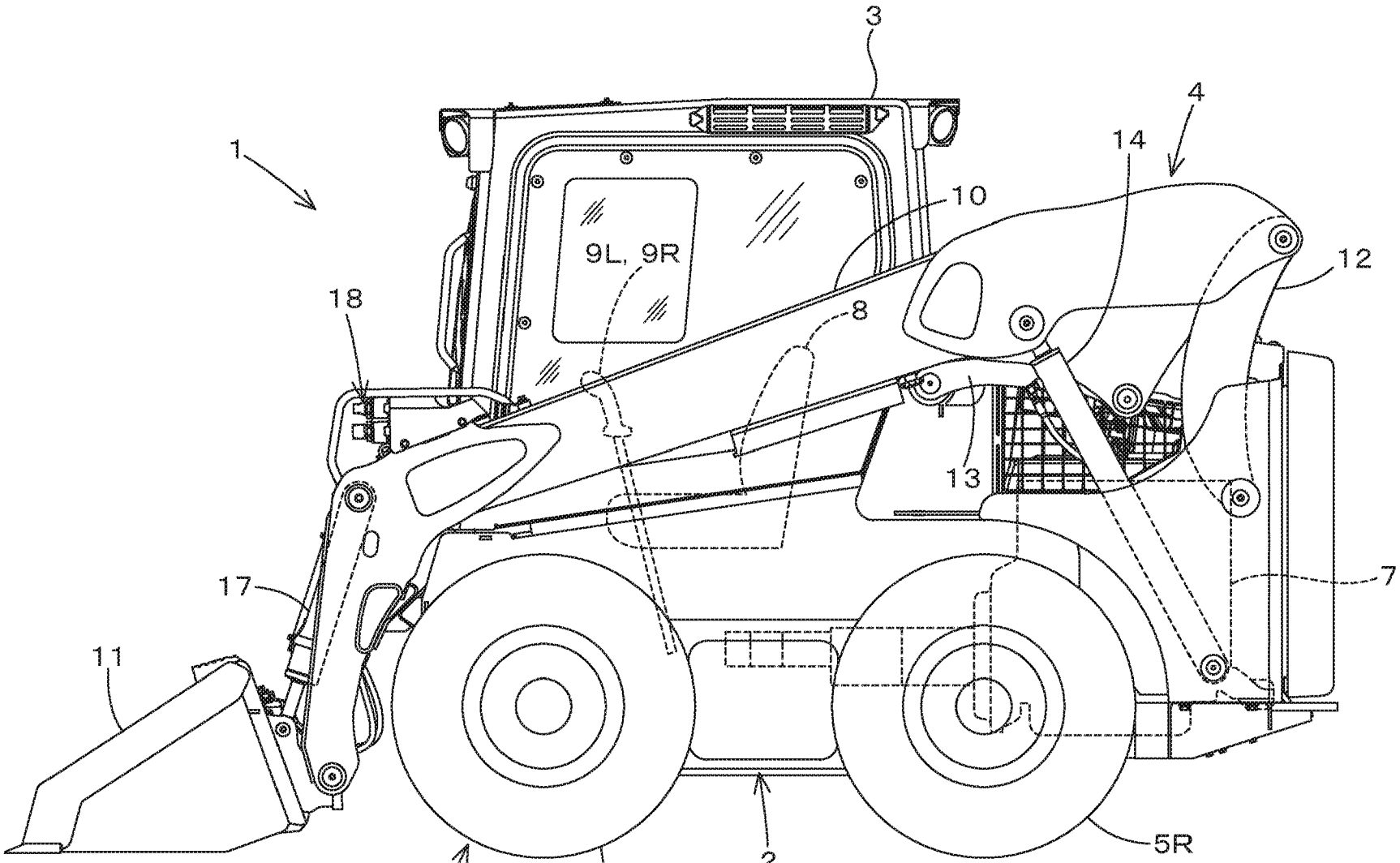
FIG. 8 is a whole view of a skid steer loader exemplified as the working machine according to the embodiment.

Firstly, the working machine will be explained. FIG. 8 shows a side view of the working machine according to the present invention. In FIG. 8, a skid steer loader is shown as an example of the working machine.

However, the working machine according to the present invention is not limited to the skid steer loader. For example, the working machine may be another type of loader working machine such as a compact track loader. In addition, the working machine nay be another working machine other than the loader working machine.

The working machine 1 includes a machine body (vehicle body) 2, a cabin 3, a working device 4, and traveling devices 5A and 5B.

A cabin 3 is mounted on the machine body 2. An operator seat 8 is provided at a rear portion of an inside of the cabin 3. In the embodiment of the present invention, the front side of the operator seated on the operator seat 8 of the working machine 1 (the left side in FIG. 8) is referred to as the front. The rear side of the operator (the right side in FIG. 8) is referred to as the rear. The left side of the operator (a front surface side of FIG. 8) is referred to as the left. The right side of the operator (a back surface side of FIG. 8) is referred to as the right.

In addition, a horizontal direction which is a direction orthogonal to the front-to-rear direction will be referred to as a machine width direction. And, a direction from the center portion of the machine body 2 to the right portion or the left portion will be referred to as a machine outward direction. In other words, the machine outward direction is the machine width direction separating from the machine body 2.

In the explanation, a direction opposite to the machine outward direction is referred to as a machine inward direction. In other words, the machine inward direction is the machine width direction approaching the machine body 2.

The cabin 3 is mounted on the machine body 2. The working device 4 is an apparatus that performs the work and is mounted on the machine body 2. The traveling device 5A is a device for the traveling of the machine body 2, and is provided on the left side of the machine body 2. The traveling device 5B is a device for the traveling of the machine body 2, and is provided on the right side of the machine body 2.

A prime mover 7 is provided at the rear portion of the inside of the machine body 2. The prime mover 7 is an engine (diesel engine). It should be noted that the prime mover 7 is not limited to the engine, and may be an electric motor or the like.

A traveling lever 9L is provided on the left side of the operator seat 8. A traveling lever 9R is provided on the right side of the operator seat 8. The traveling lever 9L provided on the left is for operating the travel device 5A provided on the left, and the traveling lever 9R provided on the right is for operating the travel device 5B provided on the right.

The working device 4 includes a boom 10, a bucket 11, a lift link 12, a control link 13, a boom cylinder 14, and a bucket cylinder 17. The boom 10 is provided on the side of the machine body 2.

The bucket 11 is provided at the tip end (front end) of the boom 10. The lift link 12 and the control link 13 support the base portion (rear portion) of the boom 10. The boom cylinder 14 moves the boom 10 upward and downward.

In particular, the lift link 12, the control link 13 and the boom cylinder 14 are provided on the side of the machine body 2. An upper portion of the lift link 12 is pivotally supported on an upper portion of the base portion of the boom 10. A lower portion of the lift link 12 is pivotally supported on the side portion of the rear portion of the machine body 2.

The control link 13 is arranged in front of the lift link 12. One end of the control link 13 is pivotally supported at a lower portion of a base portion of the boom 10, and the other end is pivotally supported by the machine body 2.

The boom cylinder 14 is a hydraulic cylinder configured to move the boom 10 upward and downward. The upper portion of the boom cylinder 14 is pivotally supported on the front portion of the base portion of the boom 10. The lower portion of the boom cylinder 14 is pivotally supported on the side portion of the rear portion of the machine body 2. When the boom cylinder 14 is stretched and shortened, the lift link 12 and the control link 13 swing the boom 10 upward and downward.

The bucket cylinder 17 is a hydraulic cylinder configured to swing the bucket 11. The bucket cylinder 17 couples between the left portion of the bucket 11 and the boom provided on the left, and couples between the right portion of the bucket 11 and the boom provided on the right.

In addition, in place of the bucket 11, an auxiliary attachment such as a hydraulic crusher, a hydraulic breaker, an angle broom, an auger, a pallet fork, a sweeper, a mower, a snow blower or the like can be attached to the tip end (front portion) of the boom 10.

In the present embodiment, wheel-type traveling devices 5A and 5B each having the front wheels 5F and the rear wheels 5R are adopted as the traveling devices 5A and 5B. Meanwhile, crawler type traveling devices 5A and 5B (including semi-crawler type traveling devices 5A and 5B) may be adopted as the traveling devices 5A and 5B.

Next, a working hydraulic circuit (working hydraulic system) provided in the skid steer loader 1 will be described below.

The working hydraulic system is a system configured to operate the boom 10, the bucket 11, the auxiliary attachment and the like. As shown in FIG. 1, the working hydraulic system includes a plurality of control valves 20 and a working hydraulic pump (first hydraulic pump) P1. In addition, the working hydraulic system is provided with a second hydraulic pump P2 other than the first hydraulic pump P1.

The first hydraulic pump P1 is a pump configured to be operated by the power of the prime mover 7. The first hydraulic pump P1 is constituted of a constant displacement type gear pump. The first hydraulic pump P1 is configured to output the operation fluid stored in a tank (operation fluid tank) 15.

The second hydraulic pump P2 is a pump configured to be operated by the power of the prime mover 7. The second hydraulic pump P2 is constituted of a constant displacement type gear pump. The second hydraulic pump P2 is configured to output the operation fluid stored in the tank (operation fluid tank) 15.

In the hydraulic system, the second hydraulic pump P2 outputs the operation fluid for signals and the operation fluid for controls. The operation fluid for signals and the operation fluid for controls are called a pilot fluid.

The plurality of control valves 20 are valves configured to control various types of hydraulic actuators provided in the working machine 1. The hydraulic actuator is a device configured to be operated by the operation fluid, and is constituted of a hydraulic cylinder, a hydraulic motor, or the like. In the embodiment, the plurality of control valves 20 include a boom control valve 20A, a bucket control valve 20B, and an auxiliary control valve 20C.

The boom control valve 20A is a valve configured to control the hydraulic actuator (boom cylinder) 14 that moves the boom 10. The boom control valve 20A is constituted of a direct-acting spool type three-position switching valve (a direct-acting spool type three-position selector valve).

The boom control valve 20A is configured to be switched to a neutral position 20*a*3, to a first position 20*a*1 other than the neutral position 20*a*3, and to a second position 20*a*2 other than the neutral position 20*a*3 and the first position 20*a*1.

In the boom control valve 20A, the switching between the neutral position 20*a*3, the first position 20*a*1, and the second position 20*a*2 is performed by moving the spool through operation of the operation member.

Meanwhile, the switching of the boom control valve 20A is performed by directly moving the spool through manual operation of the operation member. However, the spool may be moved by the hydraulic operation (hydraulic operation by a pilot valve, and hydraulic operation by a proportional valve).

In addition, the spool may be moved by the electric operation (electric operation by exciting the solenoid). In addition, the spool may be moved by other methods.

The boom control valve 20A and the first hydraulic pump P1 are coupled by an output fluid tube 27. A discharge fluid tube 24*a* connected to the operation fluid tank 15 is connected to a section between the boom control valve 20A and the first hydraulic pump P1.

A relief valve (main relief valve) 25 is provided to an intermediate portion of the discharge fluid tube 24*a*. The operation fluid outputted from the first hydraulic pump P1 passes through the output fluid tube 27 and is supplied to the boom control valve 20A. In addition, the boom control valve 20A and the boom cylinder 14 are coupled to each other by a fluid tube 21.

In particular, the boom cylinder 14 includes a cylindrical body 14*a*, a rod 14*b* movably provided on the cylindrical body 14*a*, and a piston 14*c* provided on the rod 14*b*.

A first port 14*d* for supplying and discharging the operation fluid is provided on the base end portion of the cylindrical body 14*a* (on the side opposite to the rod 14*b* side). A second port 14*e* for supplying and discharging the operation fluid is provided on the tip end of the cylindrical body 14*a* (on the side of the rod 14*b*).

The fluid tube 21 includes a communication fluid tube 21*a* and a communication fluid tube 21*b*. The communication fluid tube 21*a* couples the first port 31 of the boom control valve 20A to the first port 14*d* of the boom cylinder 14. The communication fluid tube 21*b* couples the second port 32 of the boom control valve 20A to the second port 14*e* of the boom cylinder 14.

Thus, when the boom control valve 20A is set to the first position 20*a*1, the operation fluid can be supplied from the communication fluid tube 21*a* to the first port 14*d* of the boom cylinder 14, and further the operation fluid can be discharged from the second port 14*e* of the boom cylinder 14 to the communication fluid tube 21*b*. In this manner, the boom cylinder 14 is stretched, and thereby the boom 10 moves upward.

When the boom control valve 20A is set to the second position 20*a*2, the operation fluid can be supplied from the communication fluid tube 21*b* to the second port 14*e* of the boom cylinder 14, and further the operation fluid can be discharged from the first port 14*d* of the boom cylinder 14 to the communication fluid tube 21*a*. In this manner, the boom cylinder 14 is shortened, and thereby the boom 10 moves downward.

The bucket control valve 20B is a valve configured to control the hydraulic cylinder (bucket cylinder) 17 that controls the movement of the bucket 11. The bucket control valve 20B is a three-position switching valve of pilot-actuated direct-acting spool type (a three-position selector valve of pilot-actuated direct-acting spool type).

The bucket control valve 20B is configured to be switched to a neutral position 20*b*3, to a first position 20*b*1 other than the neutral position 20*b*3, and to a second position 20*b*2 other than the neutral position 20*b*3 and the first position 20*b*1. In the bucket control valve 20B, the switching between the neutral position 20*b*3, the first position 20*b*1, and the second position 20*b*2 is performed by moving the spool through operation of the operation member.

Meanwhile, the switching of the bucket control valve 20B is performed by directly moving the spool through manual operation of the operation member. However, the spool may be moved by the hydraulic operation (hydraulic operation by a pilot valve, and hydraulic operation by a proportional valve). In addition, the spool may be moved by the electric operation (electric operation by exciting the solenoid). In addition, the spool may be moved by other methods.

The bucket control valve 20B and the bucket cylinder 17 are coupled by a fluid tube 22. More specifically, the bucket cylinder 17 includes a cylindrical body 17*a*, a rod 17*b* movably provided on the cylindrical body 17*a*, and a piston 17*c* provided on the rod 17*b*.

A first port 17*d* for supplying and discharging the operation fluid is provided on the base end portion (the side opposite to the rod 17*b* side) of the cylindrical body 17*a*. A second port 17*e* for supplying and discharging the operation fluid is provided on the tip end (the side of the rod 17*b*) of the cylindrical body 17*a*.

The fluid tube 22 includes a communication fluid tube 22*a* and a communication fluid tube 22*b*. The communication fluid tube 22*a* couples the first port 35 of the bucket control valve 20B to the second port 17*e* of the bucket cylinder 17. The communication fluid tube 22*b* couples the second port 36 of the bucket control valve 20B to the first port 17*d* of the bucket cylinder 17.

Thus, when the bucket control valve 20B is set to the first position (shoveling position) 20*b*1, the operation fluid can be supplied from the communication fluid tube 22*a* to the second port 17*e* of the bucket cylinder 17, and further the operation fluid can be discharged from the first port 17*d* of the bucket cylinder 17 to the communication fluid tube 22*b*.

In this manner, the bucket cylinder 17 is shortened, and thereby the bucket 11 performs the shoveling operation. When the bucket control valve 20B is set to the second position (dumping position) 20*b*2, the operation fluid can be supplied from the communication fluid tube 22*b* to the first port 17*d* of the bucket cylinder 17, and further the operation fluid can be discharged from the second port 17*e* of the bucket cylinder 17 to the communication fluid tube 22*a*. In this manner, the bucket cylinder 17 is stretched, and thereby the bucket 11 performs the dumping operation.

The auxiliary control valve 20C is a valve configured to control the hydraulic actuator (hydraulic cylinder, hydraulic motor, and the like) 16 attached to the auxiliary attachment. The auxiliary control valve 20C is a three-position switching valve of pilot-actuated direct-acting spool type (a three-position selector valve of pilot-actuated direct-acting spool type).

The auxiliary control valve 20C is configured to be switched to a neutral position 20*c*3, to a first position 20*c*1 other than the neutral position 20*c*3, and to a second position 20*c*2 other than the neutral position 20*c*3 and the first position 20*c*1. In the auxiliary control valve 20C, the switching between the neutral position 20*c*3, the first position

20*c*1, and the second position 20*c*2 is performed by moving the spool with use of a pressure of the pilot fluid.

A coupling member 18 is connected to the auxiliary control valve 20C via supplying-discharging fluid tubes 83*a* and 83*b*. A fluid tube connected to the hydraulic actuator 16 of the auxiliary attachment is connected to the coupling member 18.

Thus, when the auxiliary control valve 20C is set to the first position 20*c*1, the operation fluid can be supplied from the supplying-discharging fluid tube 83*a* to the hydraulic actuator 16 of the auxiliary attachment. When the auxiliary control valve 20C is set to the second position 20*c*2, the operation fluid can be supplied from the supplying-discharging fluid tube 83*b* to the hydraulic actuator 16 of the auxiliary attachment.

In this manner, when the operation fluid is supplied to the hydraulic actuator 16 from the supplying-discharging fluid tube 83*a* or the supplying-discharging fluid tube 83*b*, the hydraulic actuator 16 (the auxiliary attachment) can be operated.

The series circuit (series fluid tube) is employed in the hydraulic system. In the series circuit, the operation fluid returned from the hydraulic actuator to the control valve arranged on the upstream side can be supplied to the control valve arranged on the downstream side.

For example, focusing on the bucket control valve 20B and the auxiliary control valve 20C, the bucket control valve 20B is the control valve arranged on the upstream side, and the auxiliary control valve 20C is the control valve arranged on the downstream side.

Hereinafter, the control valve arranged on the upstream side is referred to as a "first control valve", and the control valve arranged on the downstream side is referred to as a "second control valve". A control valve other than the first control valve and the second control valve and provided on the upstream side upper from the second control valve is referred to as a "third control valve".

In addition, the hydraulic actuator corresponding to the first control valve is referred to as a "first hydraulic actuator". The hydraulic actuator corresponding to the second control valve is referred to as a "second hydraulic actuator". The hydraulic actuator corresponding to the third control valve is referred to as a "third hydraulic actuator".

The fluid tube for supplying the return fluid to the second control valve is referred to as a "first fluid tube", the return fluid being the operation fluid returning from the first hydraulic actuator to the first control valve.

In the embodiment, the bucket control valve 20B corresponds to the "first control valve". The auxiliary control valve 20C corresponds to the "second control valve". The boom control valve 20A corresponds to the "third control valve". In addition, the bucket cylinder 17 corresponds to the "first hydraulic actuator". The hydraulic actuator 16 of the auxiliary attachment corresponds to the "second hydraulic actuator". The boom cylinder 14 corresponds to the "third hydraulic actuator".

Hereinafter, the relationship between the first control valve 20A and the second control valve 20B will be described in detail.

The first control valve 20A is coupled to the output portion of the first hydraulic pump P1 by an output fluid, tube 27. The output fluid tube 27 is branched at the intermediate portion 27*a*. The branched fluid tube of the output fluid tube 27 is connected to the first input port 46*a* and the second input port 46*b* of the first control valve 20A.

In addition, the output fluid tube 27 is connected to the third input port 46*c* of the first control valve 20A. Thus, the hydraulic fluid outputted from the first hydraulic pump P1 can be supplied to the first control valve 20A through the output fluid tube 27, the first input port 46*a*, the second input port 46*b*, and the third input port 46*c*.

The first control valve 20A is coupled to the second control valve 20B by a central fluid tube 51. The central fluid tube 51 couples the third output port 41*c* of the first control valve 20A to the third input port 42*c* of the second control valve 20B.

When the first control valve 20A is set to the neutral position 20*a*3, the supply fluid, which is the operation fluid supplied from the output fluid tube 27 to the first control valve 20A, is supplied to the central fluid tube 51 through the first control valve 20A due to the communication of the central fluid tube 53*c* coupling between the third input port 46*c* and the third output port 41*c*.

The first control valve 20A is coupled to the second control valve 20B by a fluid tube (first fluid tube) 61 separately from the central fluid tube 51. The first fluid tube 61 is a fluid tube that supplies, to the second control valve 20B, the return fluid returning from the first hydraulic actuator 14 to the first control valve 20A through the first control valve 20A.

The first fluid tube 61 includes a communication fluid tube (first coupling fluid tube) 21*a*, a first inner fluid tube 61*a*, and an outer fluid tube 61*b*. The first coupling fluid tube 21*a* is a fluid tube that couples the first port 31 of the first control valve 20A to the first port 14*d* of the first hydraulic actuator 14, and the return fluid having discharged from the first port 14*d* of the first hydraulic actuator 14 flows in the first coupling fluid tube 21*a*.

The first inner fluid tube 61*a* is a fluid tube provided in the first control valve 20A and communicated with the first coupling fluid tube 21*a*. More specifically, the first inner fluid tube 61*a* is a fluid tube that couples the first port 31 of the first control valve 20A to the first output port 41*a* of the first control valve 20A when the first control valve 20A is set to the second position 20*a*2.

The outer fluid tube 61*b* is a fluid tube that is communicated with the first inner fluid tube 61*a* and is connected to the second control valve 20B. The outer fluid tube 61*b* couples the first output port 41*a* of the first control valve 20A to the first input port 42*a* of the second control valve 20B, and couples the second output port 41*b* of the first control valve 20A to the second input port 42*b* of the second control valve 20B.

An intermediate portion of the outer fluid tube 61*b* is connected to the central fluid tube 51. That is, the outer fluid tube 61*b* and the central fluid tube 51 are connected to each other in the middle portions thereof. The first fluid tube 61 is provided with a first throttle portion (first throttle) 150 configured to reduce the flow rate of the operation fluid.

In particular, the first throttle portion 150 is provided in the first inner fluid tube 61*a*. The first throttle portion 150 is provided in a section between a connecting portion 155 connecting the second fluid tube 110 to the first inner fluid tube 61*a* and the first port 31 of the first control valve 20A.

The opening area of the first throttle portion 150 is smaller than the opening area of the first inner fluid tube 61*a*. The opening area is a cross-sectional area (passage cross-sectional area) of a portion through which the operation fluid flows.

According to the above configuration, when the first control valve 20A is set to the second position 20*a*2 which is the lateral position, the supply fluid introduced to the second input port 46*b* passes through the second port 32 and the communication fluid tube 21*b*, and enters the second port

14*e* of the first hydraulic actuator 14. When the supply fluid is supplied to the second port 14*e*, the first hydraulic actuator 14 is shortened, for example.

When the first hydraulic actuator 14 is shortened, the return fluid discharged from the first port 14*d* of the first hydraulic actuator 14 passes through the first coupling fluid tube 21*a* and flows into the first inner fluid tube 61*a*, and the return fluid form the first inner fluid tube 61*a* passes through the outer fluid tube 61*b* and flows toward the second control valve 20B. Thus, the return fluid from the first hydraulic actuator 14 can be supplied to the second control valve 20B.

Next, the relationship between the second control valve 20B and the third control valve 20C will be described in detail.

The second control valve 20B and the third control valve 20C are coupled by the central fluid tube 72. The central fluid tube 72 couples the third output port 43*c* of the second control valve 20B to the third input port 44*c* of the third control valve 20C.

Thus, when the second control valve 20B is set to the neutral position 20*b*3, the supply fluid which is the operation fluid supplied to the second control valve 20B flows through the central fluid tube 73*c* that couples the third input port 42*c* to the third output port 43*c*, and is supplied to the central fluid tube 72 connected to the third output port 43*c*.

The second control valve 20B is coupled to the third control valve 20C by a fluid tube 81 separately from the central fluid tube 72. The fluid tube 81 is a fluid tube that supplies the return fluid to the third control valve 20C through the second control valve 20B, the return fluid returning from the second hydraulic actuator 17 to the second control valve 20B.

The fluid tube 81 includes a communication fluid tube 22*a*, a communication fluid tube 81*a*, and a communication fluid tube 81*b*. The communication fluid tube 22*a* is a fluid tube that couples the first port 35 of the second control valve 20B to the second port 17*e* of the second hydraulic actuator 17. The return fluid discharged from the second port 17*e* flows in the fluid tube 81*a*.

The communication fluid tube 81*a* is a fluid tube that is provided in the second control valve 20B and is communicated with the communication fluid tube 22*a*. More specifically, the communication fluid tube 81*a* is a fluid tube that couples the first port 35 of the second control valve 20B to the first output port 43*a* of the second control valve 20B when the second control valve 20B is set to the second position 20*b*2.

The communication fluid tube 81*b* is a fluid tube that is communicated with the communication fluid tube 81*a* and is connected to the third control valve 20C. The communication fluid tube 81*b* couples the first output port 43*a* of the second control valve 20B to the first input port 44*a* of the third control valve 20C, and couples the second output port 43*b* of the second control valve 20B to the second input port 44*b* of the third control valve 20C. The middle portion of the communication fluid tube 81*b* is connected to the central fluid tube 72.

According to the above configuration, when the second control valve 20B is set to the second position 20*b*2 which is the lateral position, the supply fluid introduced into the second input port 42*b* passes through the second port 36 and the communication fluid tube 22*b* and enters the first port 17*d* of the second hydraulic actuator 17. When the supply fluid is supplied to the first port 17*d*, the second hydraulic actuator 17 is stretched, for example.

When the second hydraulic actuator 17 is stretched, the return fluid discharged from the second port 17*e* of the second hydraulic actuator 17 passes through the communication fluid tube 22*a* and flows to the communication fluid tube 81*a*, and the return fluid from the communication fluid tube 81*a* flows toward the third control valve 20C through the communication fluid tube 81*b*. Thus, the return fluid from the second hydraulic actuator 17 can be supplied to the third control valve 20C.

The hydraulic system for the working machine includes a discharge fluid tube 24*b* configured to discharge the operation fluid to the hydraulic fluid tank 15 and the like. The discharge fluid tube 24*b* includes a fluid tube 24*b*1, a fluid tube 24*b*2, and a fluid tube 24*b*3. The fluid tube 24*b*1 is a fluid tube that is connected to the communication fluid tube 21*b*. A relief valve 37 is provided in the middle of the fluid tube 24*b*1. The fluid tube 24*b*2 is a fluid tube that is connected to the first discharge port 33*a* and the second discharge port 33*b* of the first control valve 20A. The fluid tube 24*b*3 is a fluid tube that couples the hydraulic oil tank 15 to the confluent portion between the fluid tube 24*b*1 and the fluid tube 24*b*2.

In addition, the discharge fluid tube 24*b* includes a fluid tube 24*b*4 and a fluid tube 24*b*5. The fluid tube 24*b*4 is a fluid tube connected to the communication fluid tube 22*b*. A relief valve 38 is provided in the middle of the fluid tube 24*b*1. The fluid tube 24*b*5 is a fluid tube connected to the communication fluid tube 22*a*, the first discharge port 34*a* and the second discharge port 34*b* of the second control valve 20B. The fluid tube 24*b*6 couples the fluid tube 24*b*3 to the joining portion of the fluid tube 24*b*1.

Figure 2:
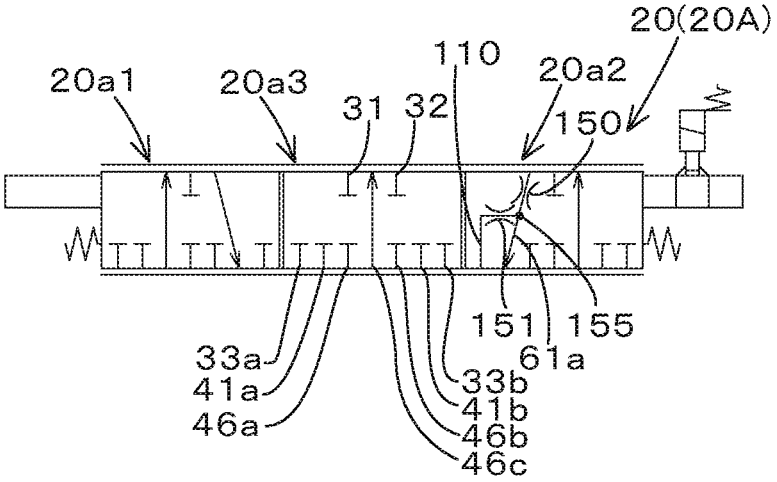
FIG. 2 is an enlarged view illustrating a first control valve according to the embodiment.

As shown in FIG. 1 and FIG. 2, the hydraulic system for the working machine is provided with a fluid tube (second fluid tube) 110. The second fluid tube 110 is a fluid tube that couples the first fluid tube 61 to the output fluid tube 24*b*. The second fluid tube 110 is an inner fluid tube that is provided in the first control valve 20A and couples the first inner fluid tube 61*a* of the first fluid tube 61 to the fluid tube 24*b*2 of the discharge fluid tube 24*b*.

In particular, the second fluid tube 110 couples the first inner fluid tube 61*a* to the first discharge port 33*a* (fluid tube 24*b*2) when the first control valve 20 is set to the second position 20*a*2. The second fluid tube 110 is provided with a second throttle portion (second throttle) 151 configured to reduce the flow rate of the operation fluid.

Specifically, the second throttle portion 151 is provided in the section of the second fluid tube 110 between the connecting portion 155 and the first discharge port 33*a*. The opening area (the cross-sectional area of the portion through which the operation fluid flows) of the second throttle portion 151 is smaller than the opening area (the cross-sectional area of the portion through which the operation fluid flows) of the second fluid tube 110. In addition, the opening area of the second throttle portion 151 is smaller than the opening area of the first throttle portion 150.

According to the above configuration, when the first control valve 20A is set to the second position (moving-down position) 20*a*2, the first hydraulic actuator 14 serving as the boom cylinder is shortened, and the boom 10 performs the operation of moving the boom downward. When the operation of moving the boom downward is performed, the return fluid returns from the first hydraulic actuator 14 to the first control valve 20A.

Here, since the opening area of the second throttle portion 151 is smaller than the opening area of the first throttle portion 150, the pressures of the fluid tubes, the first inner fluid tube 61*a* and the outer fluid tube 61*b*, in which the return fluid flows can be highly maintained. As the result, when the boom is moved downward, the return fluid can be pressured and fed to the downstream section, that is, to the second control valve 20B.

On the other hand, the following description will describe a case where the movement of the second hydraulic actuator 17 serving as the bucket cylinder is stopped by an external force and where the supply of the operational fluid is stopped under the situation where the operation of the bucket 11 and the like is performed while simultaneously the boom is moved downward. In other words, a case will be considered below where the return fluid passes through the first fluid tube 61 and is not introduced into the first input port 42*a* and the second input port 42*b* of the second control valve 20B.

Under such situations, when the second fluid tube 110 is not provided in the first control valve 20A, the return fluid in the first fluid tube 61 has no way to flow and the operation of the boom cylinder may be slow down in some cases. On the other hand, when the operation fluid is not introduced into the first input port 42*a* and the second input port 42*b* of the second control valve 20B in the case where the second fluid tube 110 is provided in the first control valve 20A, the return fluid from the first fluid tube 61 can be discharged from the second fluid tube 110 to the discharge fluid tube 24*b*, and thus the boom cylinder (the boom 10) can be smoothly operated.

Figure 3:
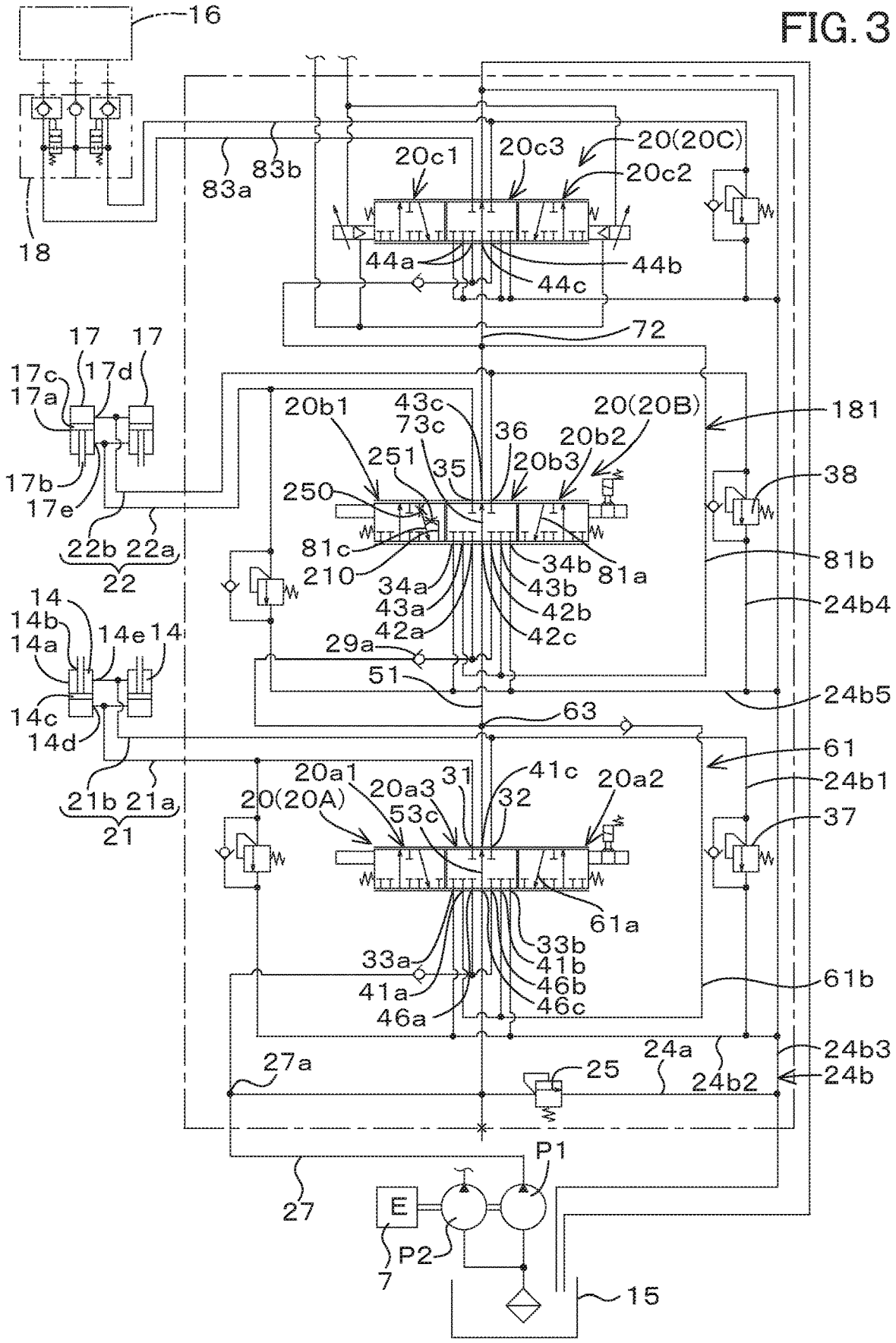
FIG. 3 is a view illustrating a first modified example of the hydraulic system for the working machine according to the embodiment.
Figure 4:
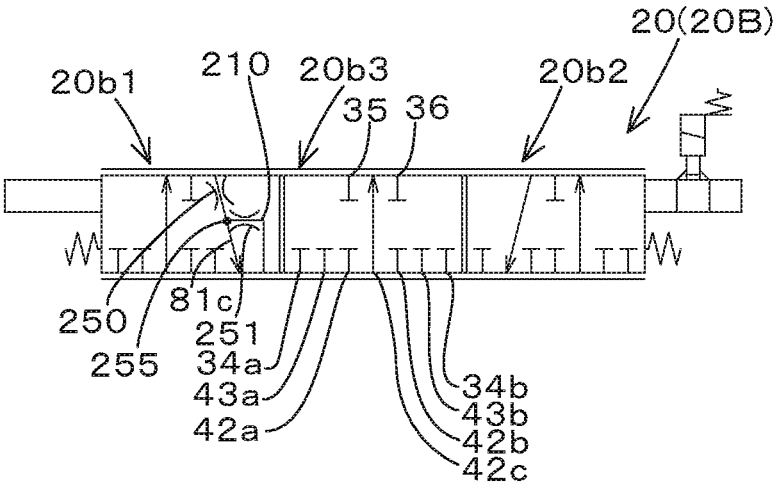
FIG. 4 is an enlarged view illustrating a first control valve of a first modified example according to the embodiment.

FIG. 3 and FIG. 4 show a first modified example of the hydraulic system for the working machine. In the first modified example, the bucket control valve 20B is referred to as the "first control valve", the auxiliary control valve 20C is referred to as the "second control valve", and the boom control valve 20A is referred to as the "third control valve".

In the first modified example, the bucket cylinder 17 is referred to as the "first hydraulic actuator", the hydraulic actuator 16 of the auxiliary attachment is referred to as the "second hydraulic actuator", and the boom cylinder 14 is referred to as the "third hydraulic actuator".

In the first modified example, the first fluid tube corresponds to the fluid tube 181, the second fluid tube corresponds to the fluid tube 210 provided in the one control valve 20B, and the first throttle portion corresponds to the throttle portion 250 arranged in the fluid tube 181, and the second throttle portion corresponds to the throttle portion 251 arranged in the fluid tube 210.

The fluid tube 181 includes a communication fluid tube (first coupling fluid tube) 22*b*, a communication fluid tube (first inner fluid tube) 81*c*, and a communication fluid tube 81*b*. The first inner fluid tube 81*c* is a fluid tube provided in the first control valve 20B and communicated with the first coupling fluid tube 22*b*.

More specifically, the first inner fluid tube 81*c* is a fluid tube that couples the second port 36 of the first control valve 20B to the second output port 43*b* of the first control valve 20B when the first control valve 20B is set to the first position 20*b*1. The first inner fluid tube 81*c* is communicated with the communication fluid tube 81*b* when the first control valve 20B is set to the first position 20*b*1.

The first inner fluid tube 81*c* is provided with the throttle portion 250 arranged in the fluid tube 181. The opening area of the throttle portion 250 is smaller than the opening area of the first inner fluid tube 81*c*.

The fluid tube 210 is a fluid tube coupling the fluid tube 181 to the discharge fluid tube 24*b*. The first control valve 20B is provided with the fluid tube 210, and is an inner fluid tube that couples the first inner fluid tube 81 of the fluid tube 181 to the fluid tube 24*b*5 of the output fluid tube 24*b*. Specifically, the fluid tube 210 couples the first inner fluid tube 81*c* to the second discharge port 34*b* (fluid tube 24*b*5) when the first control valve 20B is set to the first position 20*b*1.

The throttle portion 251 provided in the fluid tube 210 is arranged in a section of the fluid tube 210 between the second discharge port 34*b* of the first control valve 20B and the connecting portion 255 at which the fluid tube 210 is connected to the first inner fluid tube 81*c*. The opening area of the throttle portion 251 is smaller than the opening area of the fluid tube 210. In addition, the opening area of the throttle portion 251 is smaller than the opening area of the throttle portion 250.

According to the first modified example described above, when the first control valve 20B is set to the first position (shoveling position) 20*b*1, the first hydraulic actuator 17 serving as a bucket cylinder is stretched, and the bucket 11 performs the shoveling operation. When the shoveling operation is performed, the return fluid returns from the first hydraulic actuator 17 to the first control valve 20B.

Here, since the opening area of the second throttle portion 251 is smaller than the opening area of the first throttle portion 250, the pressures of the fluid tubes, the first inner fluid tube 81*c* and the outer fluid tube 81*b*, through which the return fluid flows can be set to high pressures. As the result, the return fluid can be pressured and fed to the downstream section, that is, to the second control valve 20C in the shoveling operation of the bucket.

On the other hand, since the return fluid from the fluid tube 181 can be discharged from the fluid tube 210 to the discharge fluid tube 24*b* under the situation where the operation of the auxiliary actuator is performed while simultaneously performing the shoveling operation of the bucket, the bucket cylinder (bucket 11) can be operated smoothly.

Figure 5:
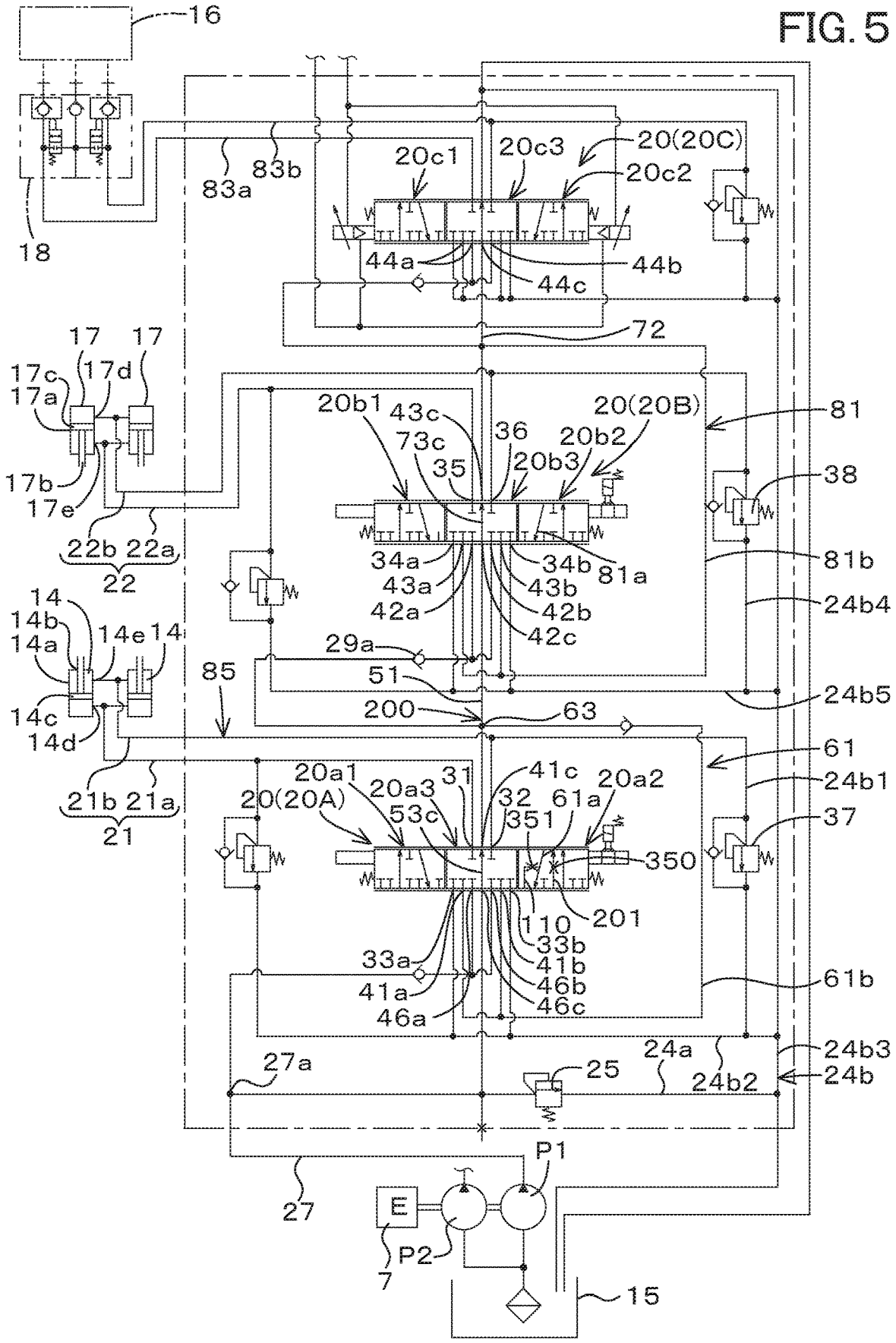
FIG. 5 is a view illustrating a second modified example of the hydraulic system for the working machine according to the embodiment.

FIG. 5 shows a second modified example of the hydraulic system for the working machine. In the second modified example, the boom control valve 20A is referred to as the "first control valve", the bucket control valve 20B is referred to as the "second control valve", and the auxiliary control valve 20C is referred to as the "third control valve". In the second modified example, the boom cylinder 14 is referred to as the "first hydraulic actuator", the bucket cylinder 17 is referred to as the "second hydraulic actuator", and the hydraulic actuator 16 of the auxiliary attachment is referred to as the "third hydraulic actuator". In the second modified example, the first fluid tube corresponds to the fluid tube 61, and the second fluid tube corresponds to the fluid tube 110.

The hydraulic system for the working machine in the second modified example includes a fluid tube (third fluid tube) 200.

The third fluid tube 200 is a fluid tube that couples the first control valve 20A to the second control valve 20B separately from the fluid tube 61, and is a fluid tube that supplies, toward the second control valve 20B, the operation fluid having passed through the first control valve 20A, that is, the operation fluid supplied to the first control valve 20A. The third fluid tube 200 includes a central fluid tube 51 and a third inner fluid tube 201.

The third inner fluid tube 201 is a fluid tube that is provided in the first control valve 20A and couples the third output port 41*c* of the first control valve 20A to the third input port 46*c* of the first fluid tube 20. A when the first control valve 20A is set to the second position 20*a*2.

The hydraulic system for the working machine in the second modified example includes a third throttle portion 351 and a fourth throttle portion 350. The third throttle portion 351 is configured to reduce the flow rate of the operation fluid, and is provided in a section of the fluid tube 110 between the connecting portion 155 and the first discharge port 33*a* of the first control valve 20A. The opening area of the third throttle portion 351 is smaller than the opening area of the fluid tube 110.

The fourth throttle portion 350 is provided in the third fluid tube 200 and is configured to reduce the flow rate of the operation fluid flowing in the third fluid tube 200. More specifically, the fourth throttle portion 350 is provided in the third inner fluid tube 201 of the third fluid tube 200.

The opening area of the fourth throttle portion 350 is smaller than the opening area of the third throttle portion 351. In other words, the opening area of the third throttle portion 351 is larger than the opening area of the fourth throttle portion 350.

According to the second modified example described above, since the first control valve 20A is provided with the third inner fluid tube 201, it is possible to supply the operation fluid discharged from the first hydraulic pump P1 to the central fluid tube 51 through the third inner fluid tube 201 even when the operation of moving the boom downward is performed, that is, even when the first control valve 20A is set to the second position 20*a*2.

That is, when the operation of moving the boom downward is performed, the operation fluid (supply fluid) of the first hydraulic pump P1 can be supplied to the second control valve 20B in addition to the return fluid supplied from the first control valve 20A to the second control valve 20B.

Further, since the first control valve 20A is provided with the fluid tube 110, the return fluid and the supply fluid can be discharged to the fluid tube 110 even in a situation where it is difficult to supply the return fluid to the second control valve 20B.

Here, the pressure of the operation fluid in a case will be considered below where the operation of moving the boom downward is performed, that is, where the first hydraulic actuator 14 serving as the boom cylinder is shortened. When the operation of moving the boom downward is performed, the pressure of the operation fluid on the bottom side of the boom cylinder (the pressure on the return fluid side) tends to be low depending on the area ratio of the boom cylinder (an area ratio between the rod side and the bottom side), and the pressure of the operation fluid on the rod side of the boom cylinder (the pressure on the supply side) tends to be high.

In the second modified example, the fourth throttle portion 350 provided in the third inner fluid tube 201 has an opening area smaller than the opening area of the third throttle portion 351 provided in the fluid tube 110. In other words, the opening area of the third throttle portion 351 is larger than the opening area of the fourth throttle portion 350.

Thus, the return fluid having the lower pressure (the operation fluid flowing through the fluid tube 61) can be discharged to the fluid tube 110 by the third throttle portion 351 and the fourth throttle portion 350 in the operation of moving the boom downward, and additionally it is possible to suppress the supply amount of the supply fluid (the operation fluid flowing through the third inner fluid tube 201) having the higher pressure.

As the result, even when the flow required rate of the operation fluid is reduced in the second control valve 20B arranged on the downstream side, the boom can be operated smoothly downward or the like, for example.

Figure 6:
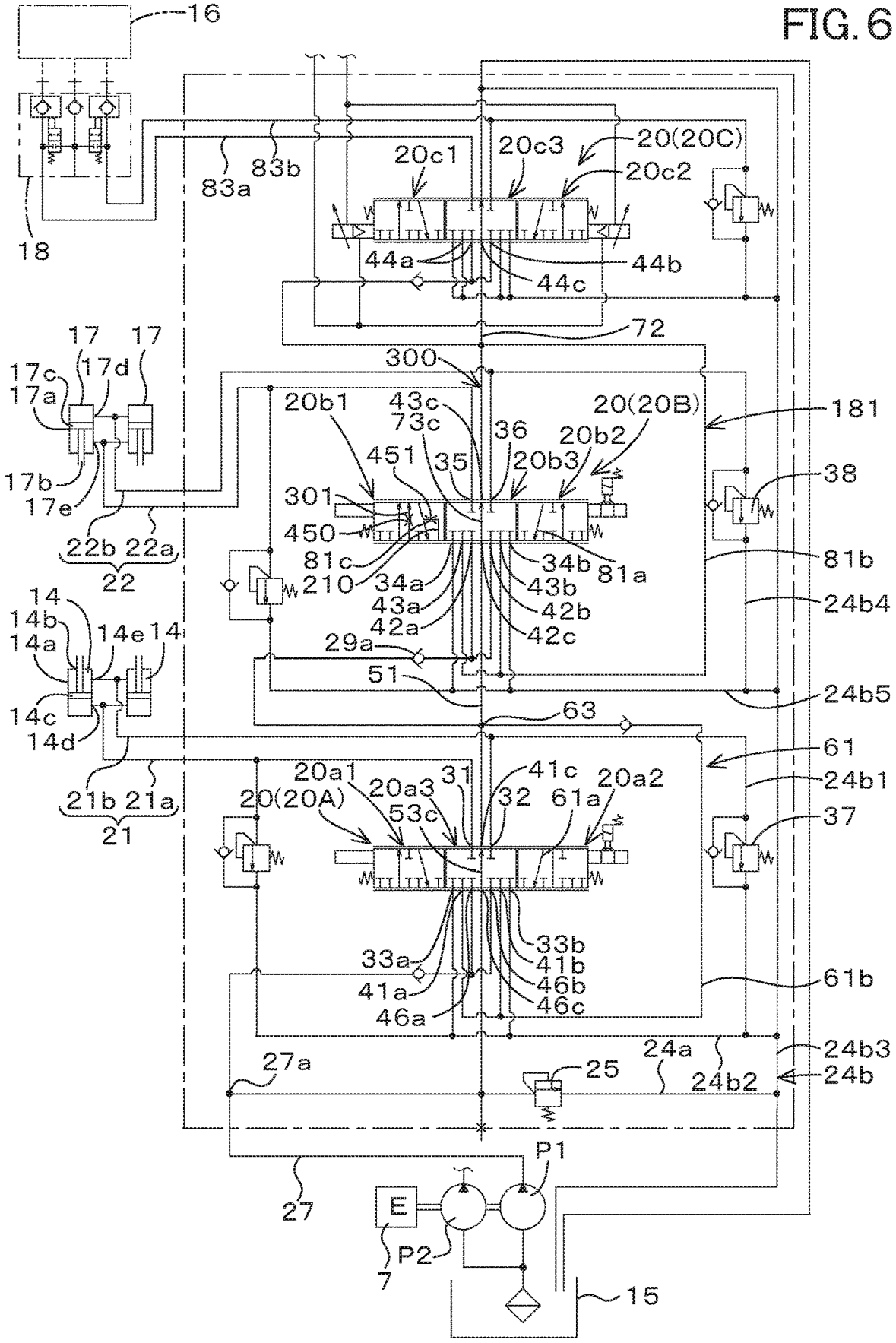
FIG. 6 is a view illustrating a third modified example of the hydraulic system for the working machine according to the embodiment.

FIG. 6 shows a third modified example of the hydraulic system for the working machine. In the third modified example, the bucket control valve 20B is referred to as the "first control valve", the auxiliary control valve 20C is referred to as the "second control valve", and the boom control valve 20A is referred to as the "third control valve".

In the third modified example, the bucket cylinder 17 is referred to as the "first hydraulic actuator", the hydraulic actuator 16 of the auxiliary attachment is referred to as the "second hydraulic actuator", and the boom cylinder 14 is referred to as the "third hydraulic actuator".

In the third modified example, the first fluid tube corresponds to the fluid tube 181, the second fluid tube corresponds to the fluid tube 210, the third fluid tube corresponds to the fluid tube 300, the third throttle portion corresponds to the throttle portion 451 arranged in the second fluid tube 210, and the fourth throttle portion corresponds to the throttle portion 450 arranged in the fluid tube 300.

The fluid tube 300 is a fluid tube that couples the first control valve 20B to the second control valve 20C separately from the fluid tube 181, and is a fluid tube that supplies the operation fluid having passed through the first control valve 20B, that is, supplies, toward the second control valve 20C, the operation fluid supplied to the first control valve 20B. The fluid tube 300 includes a central fluid tube 72 and a third inner fluid tube 301.

The third inner fluid tube 301 is a fluid tube that is provided in the first control valve 20B and couples the third output port 43*c* of the first control valve 20B to the third input port 42*c* of the first control valve 20B when the first control valve 20B is set to the first position 20*b*1.

The throttle portion 451 is configured to reduce the flow rate of the operation fluid, and is provided on a section of the fluid tube 210 between the second discharge port 34*b* of the first control valve 20B and the connecting portion where the fluid tube 210 is connected to the fluid tube 81*c*. The opening area of the throttle portion 451 is smaller than the opening area of the fluid tube 210.

The throttle portion 450 is configured to reduce the flow rate of the operation fluid flowing in the fluid tube 300, and is provided in the third inner fluid tube 301 of the fluid tube 300. The opening area of the throttle portion 450 is smaller than the opening area of the throttle portion 451. In other words, the opening area of the throttle portion 451 is larger than the opening area of the throttle portion 450.

According to the above third modified example, since the third inner fluid tube 301 is provided in the first control valve 20B, the operation fluid outputted from the first hydraulic pump P1 can be supplied to the central fluid tube 72 through the third inner fluid tube 301 even when the shoveling operation is performed, that is, the first control valve 20B is set to the first position 20*b*1.

That is, when the shoveling operation is performed, in addition to the return fluid supplied from the first control valve 20B to the second control valve 20C, the operation fluid (supply fluid) from the first hydraulic pump P1 can be supplied to the second control valve 20C arranged on the downstream side.

Here, the pressure of the operation fluid in a case will be considered below where the shoveling operation is performed, that is, where the first hydraulic actuator 17 serving as the bucket cylinder is stretched. When the shoveling operation is performed, the pressure of the operation fluid on the bottom side of the bucket cylinder (the pressure on the return fluid side) tends to be low depending on the area ratio of the bucket cylinder, and the pressure of the operation fluid on the rod side of the bucket cylinder (the pressure on the supply side) tends to be high.

In the third modified example, the throttle portion 450 provided in the third inner fluid tube 301 has an opening area smaller than the opening area of the throttle portion 451 provided in the fluid tube 210. In other words, the opening area of the throttle portion 451 is larger than the opening area of the throttle portion 450.

Thus, the throttle portion 451 and the throttle portion 450 make it possible to discharge the return fluid having a low pressure (the operation fluid flowing through the fluid tube 181) to the fluid tube 210 during the shoveling operation, while suppressing a supply amount of the high-pressured supply fluid (the operation fluid flowing through the third inner fluid tube 301).

As the result, the shoveling operation or the like can be performed smoothly, even when the required flow rate of the operation fluid is reduced in the second control valve 20C arranged on the downstream side decreases, for example.

Figure 7A:
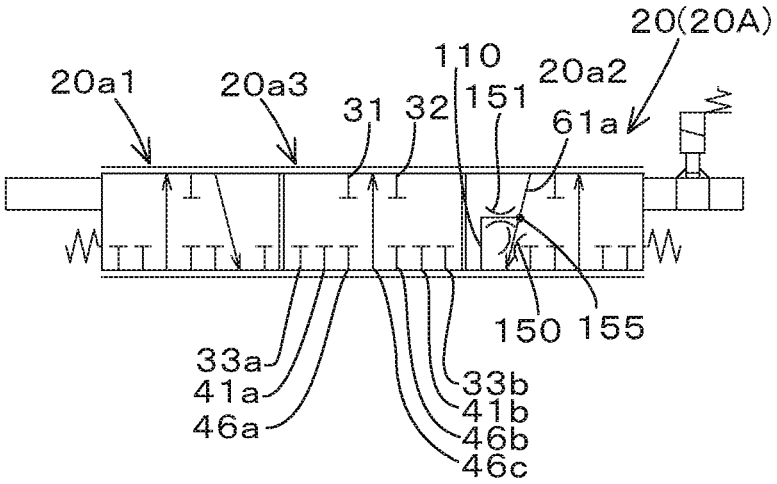
FIG. 7A is a view illustrating a fourth modified example of the hydraulic system for the working machine according to the embodiment.

FIG. 7A shows a fourth modified example in which the position of the first throttle portion 150 is changed in the first control valve 20A shown in FIG. 2. As shown in FIG. 7A, the first throttle portion 150 is provided in a section between the first output port 41*a* of the first control valve 20A and the connecting portion 155 where the second fluid tube 110 is connected to the first inner fluid tube 61*a*. The opening area of the first throttle portion 150 is smaller than the opening area of the first inner fluid tube 61*a*.

Figure 7B:
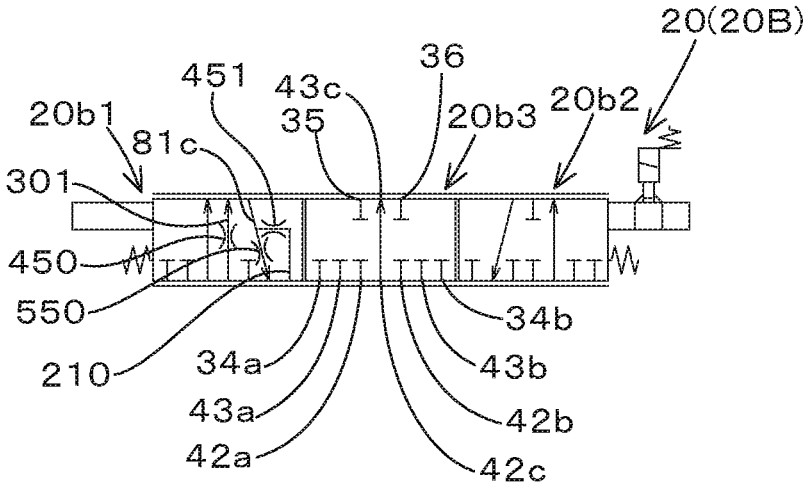
FIG. 7B is a view illustrating a fifth modified example of the hydraulic system for the working machine according to the embodiment.

FIG. 7B shows a fifth modified example in which the first throttle portion 550 is provided in the first control valve 20B shown in FIG. 6. As shown in FIG. 7B, the first throttle portion 550 is provided in a section between the second output port 43*b* and the connecting portion where the second fluid tube 210 is connected to the fluid tube 81*c*.

The opening area of the first throttle portion 550 is larger than the opening area of the third throttle portion 451, and the opening area of the third throttle portion 451 is larger than the opening area of the fourth throttle portion 450.

That is, when focusing on the opening areas of the first throttle portion 550, the third throttle portion 451 and the fourth throttle portion 450, the opening area of the first throttle portion 550 is larger than the opening area of the third throttle portion 451, and the opening area of the third throttle portion 451 is larger than the opening area of the fourth throttle portion 450.

Figure 7C:
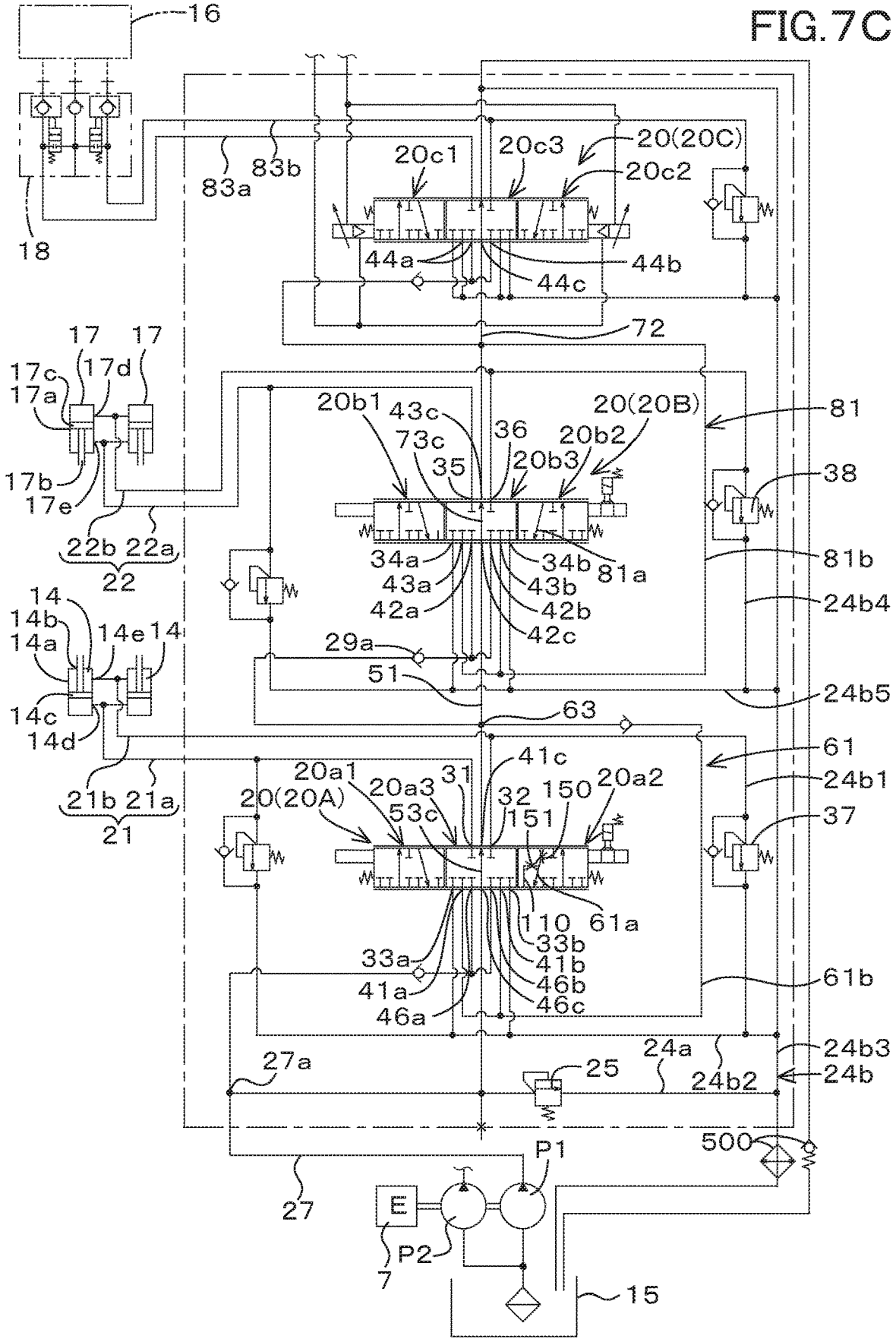
FIG. 7C is a view illustrating a sixth modified example of the hydraulic system for the working machine according to the embodiment.

FIG. 7C shows a sixth modified example in which a differential pressure generating portion 500 is provided in the hydraulic circuit of FIG. 1. The differential pressure generating part 500 is constituted of a check valve, a relief valve, an oil cooler or the like provided in the discharge fluid tube 24*b* or the like.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

The first control valve and the second control valve are not limited to the above-described embodiments, and any control valve provided in the working machine may be adopted thereto.

In the above-described embodiments, the operation fluid is discharged to the operation fluid tank. However, the operation fluid may be discharged to other places. That is, the fluid tube for discharging the hydraulic fluid may be connected to a portion other than the operation fluid tank. For example, the fluid tube may be connected to the suction portion of the hydraulic pump (the portion for sucking the operation fluid) or to another portion.

In the above-described embodiments, the control valve is constituted of a three-position selector valve. However, the number of switching positions is not limited, and the control valve may be constituted of a two-position selector valve, a four-position selector valve, or another selector valve. In the above-described embodiment, the hydraulic pump is constituted of a constant displacement pump. However, the hydraulic pump may be constituted of a variable displacement pump whose discharge amount is changed by movement of the swash plate, or may be constituted of another hydraulic pump, for example.

In addition, the first hydraulic actuator, the second hydraulic actuator, the third hydraulic actuator, the first control valve, the second control valve, and the third control valve are not limited to the configurations of the above-described embodiment, and may be those provided in the working machine 1.

What is claimed is:

1. A hydraulic system for a working machine, comprising:
- a hydraulic pump to output an operation fluid;
- a first hydraulic actuator;
- a second hydraulic actuator;
- a first control valve to control the first hydraulic actuator;
- a second control valve to control the second hydraulic actuator, the second control valve being arranged on a downstream side of the first control valve;
- a discharge fluid tube in which the operation fluid having passed through the first control valve flows, the discharge fluid tube being connected to the first control valve;
- a first fluid tube in which a return fluid that is the operation fluid returning from the first hydraulic actuator to the first control valve flows toward the second control valve, the first fluid tube coupling the first control valve to the second control valve and having a first inner fluid tube arranged inside the first control valve;
- a second fluid tube coupling the first inner fluid tube of the first fluid tube and the discharge fluid tube;
- a first throttle disposed on the first inner fluid tube of the first fluid tube; and
- a second throttle disposed on the second fluid tube and arranged inside the first control valve, the second throttle having an opening area smaller than an opening area of the first throttle.

2. The hydraulic system according to claim 1,
wherein the first fluid tube includes:
- a first coupling fluid tube in which the return fluid flows, the first coupling fluid tube coupling the first control valve and the first hydraulic actuator;
- the first inner fluid tube arranged in the first control valve and communicated with the first coupling fluid tube; and
- an outer fluid tube communicated with the first inner fluid tube, the outer fluid tube coupling the first control valve and the second control valve, and wherein the second fluid tube is arranged in the first control valve and is configured to discharge the return fluid to the discharge fluid tube.

3. The hydraulic system according to claim 2,
wherein the first throttle is disposed on the first inner fluid tube,
and wherein the second throttle is disposed on the second fluid tube.

4. The hydraulic system according to claim 3, comprising:
- a bucket; and
- a working tool arranged on a boom separately from the bucket, wherein the first hydraulic actuator is a bucket cylinder configured to move the bucket, wherein the second hydraulic actuator is a hydraulic device configured to move the working tool, and wherein the first control valve has a shoveling position and a dumping position and allows the return fluid to flow in the first inner fluid tube when the first control valve is set to the shoveling position, the shoveling position allowing the bucket cylinder to be operated to perform a shoveling operation of the bucket, the dumping position allowing the bucket cylinder to be operated to perform a dumping operation of the bucket.

5. The hydraulic system according to claim 3, comprising:

a boom; and a bucket arranged on the boom, wherein the first hydraulic actuator is a boom cylinder configured to move the boom, and wherein the second hydraulic actuator is a bucket cylinder configured to move the bucket.

6. The hydraulic system according to claim 3, comprising:

a boom; and a bucket arranged on the boom, wherein the first hydraulic actuator is a boom cylinder configured to move the boom, wherein the second hydraulic actuator is a bucket cylinder configured to move the bucket, and wherein the first control valve has a moving-up position and a moving-down position and allows the return fluid to flow in the first inner fluid tube when the first control valve is set to the moving-down position, the moving-up position allowing the boom cylinder to be operated to move the boom upward, the moving-down position allowing the boom cylinder to be operated to move the boom downward.

7. The hydraulic system according to claim 2, comprising:

a bucket; and a working tool arranged on a boom separately from the bucket, wherein the first hydraulic actuator is a bucket cylinder configured to move the bucket, wherein the second hydraulic actuator is a hydraulic device configured to move the working tool, and wherein the first control valve has a shoveling position and a dumping position and allows the return fluid to flow in the first inner fluid tube when the first control valve is set to the shoveling position, the shoveling position allowing the bucket cylinder to be operated to perform a shoveling operation of the bucket, the dumping position allowing the bucket cylinder to be operated to perform a dumping operation of the bucket.

8. The hydraulic system according to claim 2, comprising:

a boom; and a bucket arranged on the boom, wherein the first hydraulic actuator is a boom cylinder configured to move the boom, wherein the second hydraulic actuator is a bucket cylinder configured to move the bucket, and wherein the first control valve has a moving-up position and a moving-down position and allows the return fluid to flow in the first inner fluid tube when the first control valve is set to the moving-down position, the moving-up position allowing the boom cylinder to be operated to move the boom upward, the moving-down position allowing the boom cylinder to be operated to move the boom downward.

9. The hydraulic system according to claim 2, comprising:

a boom; and a bucket arranged on the boom, wherein the first hydraulic actuator is a boom cylinder configured to move the boom, and wherein the second hydraulic actuator is a bucket cylinder configured to move the bucket.

10. The hydraulic system according to claim 1, comprising:

a bucket; and a working tool arranged on a boom separately from the bucket, wherein the first hydraulic actuator is a bucket cylinder configured to move the bucket, and wherein the second hydraulic actuator is a hydraulic device configured to move the working tool.

11. The hydraulic system according to claim 1, comprising:

a boom; and a bucket arranged on the boom, wherein the first hydraulic actuator is a boom cylinder configured to move the boom, and wherein the second hydraulic actuator is a bucket cylinder configured to move the bucket.

12. A hydraulic system for a working machine, comprising:

a hydraulic pump to output an operation fluid;

a first hydraulic actuator;

a second hydraulic actuator;

a first control valve to control the first hydraulic actuator;

a second control valve to control the second hydraulic actuator, the second control valve being arranged on a downstream side of the first control valve;

a discharge fluid tube in which the operation fluid having passed through the first control valve flows, the discharge fluid tube being connected to the first control valve;

a first fluid tube in which a return fluid that is the operation fluid returning from the first hydraulic actuator to the first control valve flows toward the second control valve, the first fluid tube coupling the first control valve to the second control valve;

a second fluid tube coupling the first fluid tube and the discharge fluid tube;

a third fluid tube arranged inside the first control valve, through which the operation fluid flows from the hydraulic pump toward the second control valve separately from the first fluid tube;

a third throttle disposed on the second fluid tube and arranged inside the first control valve; and a fourth throttle disposed on the third fluid tube and arranged inside the first control valve, the fourth throttle having an opening area smaller than an opening area of the third throttle.

13. The hydraulic system according to claim 12, wherein the first fluid tube includes:

a first coupling fluid tube in which the return fluid flows, the first coupling fluid tube coupling the first control valve and the first hydraulic actuator;

a first inner fluid tube arranged in the first control valve and communicated with the first coupling fluid tube; and an outer fluid tube communicated with the first inner fluid tube, the outer fluid tube coupling the first control valve and the second control valve, wherein the second fluid tube is arranged in the first control valve and is configured to discharge the return fluid to the discharge fluid tube, and wherein the third fluid tube includes:

a central fluid tube coupling the first control valve and the second control valve separately from the first fluid tube; and a third inner fluid tube arranged in the first control valve and configured to be communicated with the central fluid tube.

14. The hydraulic system according to claim 13, wherein the third throttle is disposed on the second fluid tube, and wherein the fourth throttle is disposed on the third inner fluid tube.

15. The hydraulic system according to claim 14, comprising:

a bucket; and a working tool arranged on a boom separately from the bucket, wherein the first hydraulic actuator is a bucket cylinder configured to move the bucket, and wherein the second hydraulic actuator is a hydraulic device configured to move the working tool.

16. The hydraulic system according to claim 14, comprising:

a bucket; and a working tool arranged on a boom separately from the bucket, wherein the first hydraulic actuator is a bucket cylinder configured to move the bucket, wherein the second hydraulic actuator is a hydraulic device configured to move the working tool, and wherein the first control valve has a shoveling position and a dumping position and allows the return fluid to flow in the first inner fluid tube when the first control valve is set to the shoveling position, the shoveling position allowing the bucket cylinder to be operated to perform a shoveling operation of the bucket, the dumping position allowing the bucket cylinder to be operated to perform a dumping operation of the bucket.

17. The hydraulic system according to claim 14, comprising:

a boom; and a bucket arranged on the boom, wherein the first hydraulic actuator is a boom cylinder configured to move the boom, and wherein the second hydraulic actuator is a bucket cylinder configured to move the bucket.

18. The hydraulic system according to claim 14, comprising:

a boom; and a bucket arranged on the boom, wherein the first hydraulic actuator is a boom cylinder configured to move the boom, wherein the second hydraulic actuator is a bucket cylinder configured to move the bucket, and wherein the first control valve has a moving-up position and a moving-down position and allows the return fluid to flow in the first inner fluid tube when the first control valve is set to the moving-down position, the moving-up position allowing the boom cylinder to be operated to move the boom upward, the moving-down position allowing the boom cylinder to be operated to move the boom downward.

19. The hydraulic system according to claim 13, comprising:

a bucket; and a working tool arranged on a boom separately from the bucket, wherein the first hydraulic actuator is a bucket cylinder configured to move the bucket, wherein the second hydraulic actuator is a hydraulic device configured to move the working tool, and wherein the first control valve has a shoveling position and a dumping position and allows the return fluid to flow in the first inner fluid tube when the first control valve is set to the shoveling position, the shoveling position allowing the bucket cylinder to be operated to perform a shoveling operation of the bucket, the dumping position allowing the bucket cylinder to be operated to perform a dumping operation of the bucket.

20. The hydraulic system according to claim 13, comprising:

a boom; and a bucket arranged on the boom, wherein the first hydraulic actuator is a boom cylinder configured to move the boom, and wherein the second hydraulic actuator is a bucket cylinder configured to move the bucket.

21. The hydraulic system according to claim 13, comprising:

a boom; and a bucket arranged on the boom, wherein the first hydraulic actuator is a boom cylinder configured to move the boom, wherein the second hydraulic actuator is a bucket cylinder configured to move the bucket, and wherein the first control valve has a moving-up position and a moving-down position and allows the return fluid to flow in the first inner fluid tube when the first control valve is set to the moving-down position, the moving-up position allowing the boom cylinder to be operated to move the boom upward, the moving-down position allowing the boom cylinder to be operated to move the boom downward.

22. The hydraulic system according to claim 12, comprising:

a boom; and a bucket arranged on the boom, wherein the first hydraulic actuator is a boom cylinder configured to move the boom, and wherein the second hydraulic actuator is a bucket cylinder configured to move the bucket.

* * * * *